US005420679A

United States Patent [19]

Goto et al.

[11] Patent Number: 5,420,679

[45] Date of Patent: May 30, 1995

[54] ELASTIC ROLLER AND FIXING APPARATUS USING SAME

[75] Inventors: Masahiro Goto, Yokohama; Yasushi Sato, Kawasaki; Shunji Nakamura; Junji Araya, both of Yokohama; Tetsuo Saito, Sagamihara; Kazuo Kishino, Kawasaki; Kouichi Okuda; Yohji Tomoyuki, both of Yokohama; Akira Hayakawa, Machida; Fumitaka Aoki, Tokyo; Hirokazu Ikenoue, Inagi; Kenji Nagata, Tachikawa; Toshihiko Yamanaka, Kawasaki, all of Japan

[73] Assignee: Canon Kabushiki Kaisha, Tokyo, Japan

[21] Appl. No.: 48,067

[22] Filed: Apr. 19, 1993

Related U.S. Application Data

[63] Continuation of Ser. No. 739,494, Aug. 2, 1991, abandoned.

[30] Foreign Application Priority Data

| | | | |
|---|---|---|---|
| Aug. 3, 1990 | [JP] | Japan | 2-206594 |
| Aug. 3, 1990 | [JP] | Japan | 2-206600 |
| Aug. 31, 1990 | [JP] | Japan | 2-228255 |
| Oct. 1, 1990 | [JP] | Japan | 2-260464 |

[51] Int. Cl.[6] ..... G03G 15/20

[52] U.S. Cl. ..... 355/285; 219/216; 355/289

[58] Field of Search ..... 355/282, 285, 289, 290, 355/295, 259; 219/216, 469–471; 428/451, 219, 421, 446–447; 492/53, 56

[56] References Cited

U.S. PATENT DOCUMENTS

| | | | |
|---|---|---|---|
| 3,809,854 | 5/1974 | Sanders . | |
| 3,978,268 | 8/1976 | Kameda et al. | 428/368 |
| 4,179,601 | 12/1979 | Tarumi et al. | 219/216 |
| 4,320,714 | 3/1982 | Shimazaki et al. . | |
| 4,568,275 | 2/1986 | Sakurai . | |
| 4,674,860 | 6/1987 | Tokunaga et al. | 355/274 |
| 4,711,818 | 12/1987 | Henry . | |
| 4,804,576 | 2/1989 | Kuge et al. | 428/216 |
| 4,819,020 | 4/1989 | Matsushiro et al. . | |
| 4,842,944 | 6/1989 | Kuge et al. | 428/451 |
| 4,883,715 | 11/1989 | Kuge et al. | 428/421 |
| 4,910,559 | 3/1990 | Kuge et al. | 355/285 |
| 4,949,130 | 8/1990 | Torino | 355/282 |
| 4,994,319 | 2/1991 | Nojima et al. | 428/335 |
| 5,045,891 | 9/1991 | Senba et al. | 219/216 X |
| 5,068,692 | 11/1991 | Menjo | 355/284 |
| 5,082,596 | 1/1992 | Fukuda et al. | 252/511 |
| 5,099,285 | 3/1992 | Hirano et al. | 355/245 |
| 5,099,560 | 3/1992 | Kato et al. | 29/130 |
| 5,153,660 | 10/1992 | Goto | 355/285 |
| 5,208,638 | 5/1993 | Bujese et al. | 355/274 |

FOREIGN PATENT DOCUMENTS

| | | | |
|---|---|---|---|
| 0277651 | 8/1988 | European Pat. Off. . | |
| 0320533 | 6/1989 | European Pat. Off. . | |
| 0372518 | 6/1990 | European Pat. Off. . | |
| 424053 | 4/1991 | European Pat. Off. . | |
| 441351 | 8/1991 | European Pat. Off. . | |
| 59-031984 | 2/1984 | Japan . | |
| 59-090874 | 5/1984 | Japan . | |
| 60-019178 | 1/1985 | Japan . | |
| 60-63575 | 4/1985 | Japan . | |
| 61-038957 | 2/1986 | Japan . | |
| 61-250668 | 11/1986 | Japan . | |
| 62-34181 | 2/1987 | Japan . | |
| 63-192070 | 8/1988 | Japan . | |
| 0289572 | 11/1988 | Japan | 355/284 |
| 1227179 | 9/1989 | Japan . | |
| 2226287 | 9/1990 | Japan . | |

*Primary Examiner*—Fred L. Braun
*Assistant Examiner*—T. A. Dang
*Attorney, Agent, or Firm*—Fitzpatrick, Cella, Harper & Scinto

[57] ABSTRACT

An elastic roller includes a conductive base; an elastic layer on the conductive base; a surface parting layer on the elastic layer, the surface parting layer having a surface resistance of not less than $10^{10}$ ohm; wherein the elastic layer has a volume resistivity of not more than $10^{7}$ ohm.cm.

47 Claims, 8 Drawing Sheets

ELASTIC ROLLER AND FIXING APPARATUS USING SAME

This application is a continuation of application Ser. No. 07/739,494 filed Aug. 2, 1991, now abandoned.

FIELD OF THE INVENTION AND RELATED ART

The present invention relates to an elastic roller having a surface parting layer, and more particularly to an elastic roller usable with an image forming apparatus such as a copying machine or printer, and an image fixing apparatus using the elastic roller.

In order to improve the image fixing performance when an unfixed toner image is fixed on a recording material, it is desirable that the width of the nip formed between the fixing roller and the pressing roller which are press-contacted to each other is increased.

Generally, the elastic roller (pressing or back-up roller, for example) used in the fixing apparatus is of elastic material such as silicone rubber or the like, thus increasing the nip width. In addition, in order to prevent deterioration of the parting or releasing property of the elastic material surface with long term use, provision of a surface parting layer of fluorinated resin or the like having good parting and durability properties on the surface of the elastic material, has been proposed. This is effective to maintain for a long term the necessary elasticity and parting properties of the elastic roller.

However, since the fluorinated resin layer and the rubber layer of the elastic roller have a high resistance, the surface potential of the pressing roller becomes high due to the frictional charging between the recording material and the fixing roller, with the result that the recording material wraps around the roller or that toner offset occurs by the electrostatic repelling of the unfixed toner image on the recording material.

In view of this, a pressing roller is proposed which has an electrically conductive PFA layer as a surface parting layer on the elastic layer. However, the reduction of the resistance of the surface parting layer result in the following problems. In order to provide the fluorinated resin conductive layer, it is required that filler materials such as carbon black or the like is mixed in the fluorinated resin layer. This decreases the parting property of the fluorinated resin layer. Therefore, the contamination of the pressing roller is increased when the roller is used for a long term.

In the case of an image forming apparatus having an image bearing member and a transfer charger, if the use is made with a high resistance recording material such as OHP film or the like the conductive fluorinated surface resin layer is effective to prevent the charging of the pressing roller. However, the electric charge on the backside of the recording material leaks through the surface layer with the result of smaller force for retaining the toner on the recording material. This promotes toner off-set.

This will be described in more detail. As shown in FIG. 2, the OHP film (recording material) 211 has image transfer charge (positive, in FIG. 2) on the back side of the OHP film 211 and opposite polarity electric charge on the front side (toner image side) of the OHP film 211. The latter charge is produced when the OHP film 211 is separated from the photosensitive drum (not shown). In the case of usual recording material, the opposite polarity charges are neutralized through the recording material with the result that the transfer charge which is dominant remains as a difference. However, since the OHP film 211 has such a high resistance that the direction of the movement of the electric charge is not in the direction of the thickness thereof, and therefore, the electric charges remain on the front and back sides. When the transfer charge leaks from the pressing roller 2, the OHP film comes to have excessive electric charge of the polarity which is the same as the toner, and therefore, the force is produced to repel the toner. This results in the toner off-set to the heating roller 1.

SUMMARY OF THE INVENTION

Accordingly, it is a principal object of the present invention to provide an elastic roller and an image fixing apparatus wherein the toner off-set is prevented.

It is another object of the present invention to provide an elastic roller and an image fixing apparatus wherein the recording material is prevented from wrapping around the roller.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

The embodiments of the present invention will be described in conjunction with the accompanying drawings. In the following description, a pressing or back-up roller is taken as an example of the elastic roller, but the present invention is applicable to the fixing roller or another roller.

Figure 1:
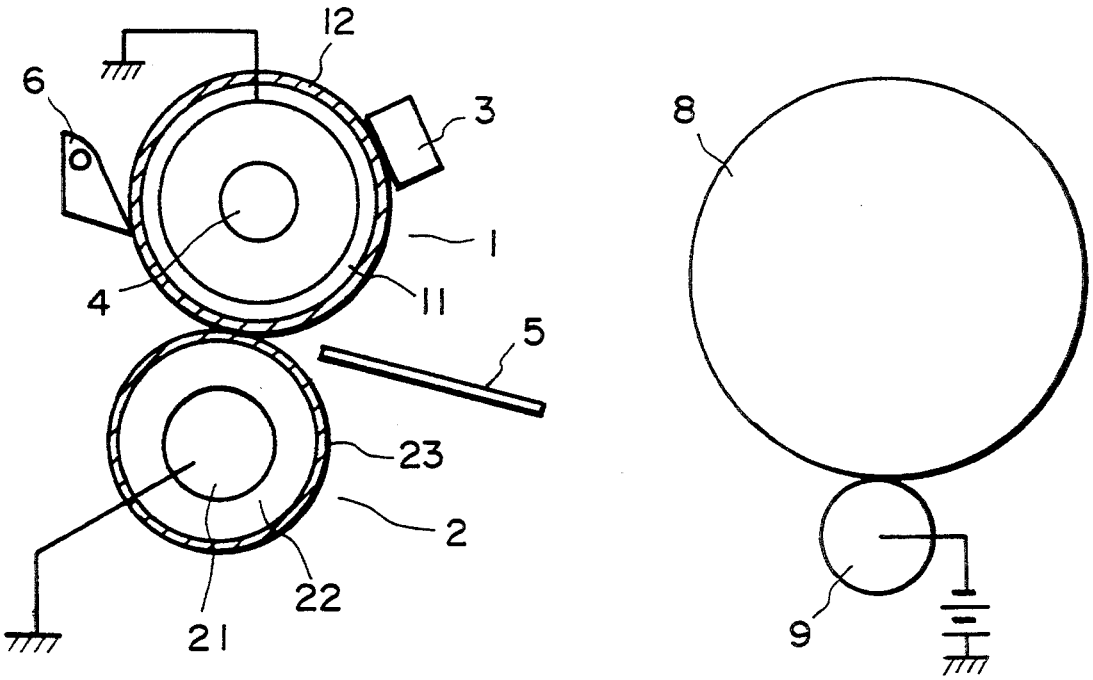
FIG. 1 is a sectional view of an image forming apparatus using an image fixing apparatus according to a first embodiment of the present invention.

FIG. 1 is a sectional view of a major part of an image fixing apparatus using an image fixing apparatus according to a first embodiment of the present invention. The image forming apparatus comprises a photosensitive drum 8 on which an unfixed toner image is formed and an image transfer charger 9 for transferring the toner image from the photosensitive drum 8 to a recording material.

A heating roller (second roller) 1 comprises a core metal (conductive base) 11 made of aluminum, SUS or iron and a resin layer 12 made of PTFE (tetrafluoroethylene resin), PFA (tetrafluoroethylene perfluorooalkoxyethylene copolymer) or the like having good heat resistive and parting properties, On the core metal 11. The pressing roller (first roller) 2 comprises a core metal (conductive base) 21 made of SUS or iron, silicone rubber (elastic material layer) 22 thereon having electric conductivity and a tube (surface parting layer) 23 thereon made of PFA, FEP (tetrafluoroethylene hexafluoropropylene copolymer). Adjacent the surface of the heating roller 1, a temperature sensor 3 such as a thermister is disposed to detect the surface temperature of the heating roller 1, and a heater 4 for heating the heating roller 1 is disposed at the center of the heating roller 1. The surface temperature of the heating roller 1 is responsive to the signal from the temperature sensor 3 to on-off controls the heater 4 at a predetermined level by an unshown controller.

Adjacent the entrance to a nip formed between the heating roller 1 and the pressing roller 2, an inlet guide 5 is disposed to introduce the transfer material into the nip. The surface of the heating roller 1 is contacted by a separating pawl 6 to separate the transfer material. In such an image fixing apparatus, the conductive core metals of the heating roller 1 and the pressing roller 2 are grounded.

Referring now to FIG. 1, the detailed description will be made as to the pressing roller 2 according to the first embodiment. The pressing roller 2, as described hereinbefore, comprises the core metal 21 made of SUS and iron and a silicone rubber layer 22 thereon in which a filler material (electrically conductive material such as carbon black), metal or metal oxide, and further comprises a resin layer 23 in the form of a tube made of PFA or FEP resin. Preferably, the conductive silicone rubber layer 22 has a thickness of 2–10 mm, and the hardness is 10–40 degrees (JIS A) if the thickness if not more than 2 mm or if the hardness if not less than 40 degrees (JIS A), it does not have the sufficiently elastic property with the result of production of crease of the transfer material when it is passed through the nip. If the thickness is not less than 10 mm or if the hardness is not more than 10 degrees (JIS A), the deformation of the rubber is too large, with the result that the resin surface layer 23 is easily creased. The resistivity of the silicone rubber layer 21 is preferably not more than $10^7$ ohm.cm (volume resistivity). This is fairly significant in the present invention, as will be understood from description hereinafter. Where a bonding layer having high resistance is used between the elastic layer and the surface parting layer, the surface resin layer 23 preferably has a thickness of 10–100 microns including the bonding layer, the surface resistance is preferably larger than $10^{10}$ ohm. They are also fairly significant in the present invention, as will be described hereinafter.

The method of producing the pressing roller 2 will be described. The core metal and PFA or FEP tube having etched inside surface are fixed in a cylinder, and the conductive silicone rubber in the form of liquid or low viscosity compound is injected into between the core metal 21 and the tube 23. Then, it is heat-cured. In another method, a vulcanized and formed conductive silicone rubber roller is coated with the PFA or FEP tube having the etched inside surface, and then, the tube is heat-shrinked. Another method is also usable.

The advantageous effects of the invention will be described with specific examples.

In the image forming apparatus of FIG. 1, the photosensitive drum 8 having organic photoconductor layer which has been charged to the negative polarity is raster-scanned with a laser beam so that an electrostatic latent image is formed. The electrostatic latent image is reverse-developed with negatively charged toner. The toner image is transferred onto a transfer material by a transfer roller supplied with positive voltage. Thus, the image forming apparatus is in the form of a laser beam printer. The image forming speed thereof is 60 mm/sec, and is capable of printing 10 transfer sheets having A4 size per minute. The fixing apparatus has a heating roller 1 having a core metal having a diameter of 29.9 mm and a PFA layer thereon having a thickness of 30 microns. The pressing roller 2 has a core metal having an outer diameter of 10 mm, a conductive silicone rubber thereon having a thickness of 6 mm and a volume resistivity of $10^3$ ohm.cm provided by a proper amount of carbon black thereinto, and a PFA tube thereon having a thickness of 50 microns. The pressing roller was used in the above-described laser beam printer. In order to evaluate the toner off-set property, the used transfer material in use was plain paper having a basis weight of 128 g/m$^2$, and another transfer material used was an OHP (overhead projector) resin film having a thickness of 100 microns and made of polyester film coated with a coating material comprising vinyl acetate binder and surface active agent. For the evaluation of the toner off-set, lateral lines with 2 dot thickness were formed with spaces having 5 dot thickness in the leading half of the transfer material (scanning line density of 300 dpi), and the toner off-set is evaluated on the basis of whether the image is retransferred from the heating roller 1 to the transfer material as toner off-set image in the trailing half.

As a result, it has been found that the toner does not offset, and the transfer material is not wrapped around the roller. The contamination of the pressing roller and the off-set did not occur after 300,000 sheets of A4 size were processed.

Figure 2:
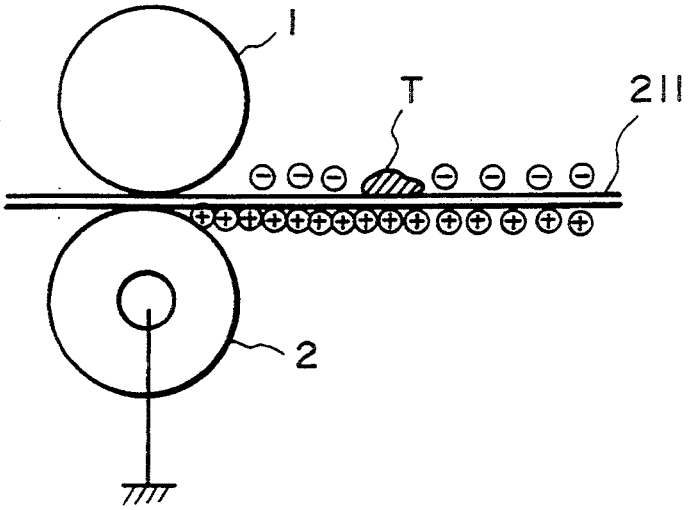
FIG. 2 shows the electric charge on the front and back side of a recording material.

The good performance of the apparatus according to this embodiment are provided for the following reasons. As shown in FIG. 2, the OHP film has transfer charge (positive in this embodiment) on the backside thereof and opposite polarity charge produced on the front side of the OHP film 211. The latter charge is produced when the OHP film 211 is separated from the photosensitive drum (not shown). In the case of usual transfer materials, the opposite polarity charge is neutralized through the transfer material, and the dominant transfer charge remains as a difference. However, in the case of the high resistivity transfer material such as the OHP film 211, the electric charge does not move through the thickness thereof, and therefore, the electric charge remains on each of the front and backsides. If the transfer charge leaks from the pressing roller 2, the OHP film comes to have excessive electric charge having the same polarity as the toner. As a result, the toner is deposited on the heating roller 1 with the result of toner off-set produced.

In this embodiment, the resistance of the surface layer of the pressing roller is sufficiently high, and therefore, the backside charge of the OHP film does not leak through the pressing roller. Therefore, the toner on the surface of the OHP film is sufficiently retained. On the other hand, as to the wrapping of the transfer material around the pressing roller or the repelling of the toner on the transfer material due to the triboelectric charge on the pressing roller 2, the electrostatic capacity of the pressing roller is increased by the use of the conductive rubber as the elastic layer of the pressing roller 2, and therefore, even if the triboelectric charge is produced on the surface of the pressing roller 2 by the friction with the transfer material, the potential is low. For this reason, the electrostatic force is not enough to repel the toner on the transfer material and not enough to wrap the transfer material around the roller. As regards the high durability of the pressing roller, the surface fluorinated resin layer provides sufficient durability, and since the filler material is not used, the parting property is excellent. Therefore, the roller is not contaminated even if it is used for a long term. The resistivity of the elastic layer is controlled with the use of material such as carbon black or metal powder which has durability against heat and property change, and therefore, the resistance does not change for a long term use, and in addition, the stability against ambient change is good. The off-set preventing property or the like does not change from the start of the use of the image forming apparatus under the variation in the ambience. Additionally, in this embodiment, since the electrostatic capacity of the pressing roller 2 is large so as to prevent the electric charging of the pressing roller 2, and therefore, the fluorinated resin surface layer is not necessarily contacted by electrically conducted blush for the purpose of releasing the electric charge.

The preferable ranges of various values on the basis of the inventors' investigations, are as follows.

Figure 3:
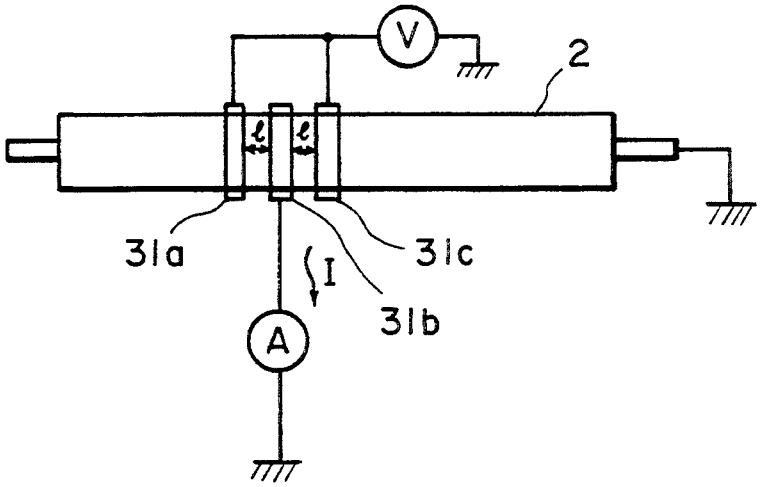
FIG. 3 shows a method of measuring a surface resistance of an elastic roller.

(1) The resistivity of the fluorinated resin surface layer is selected to suppress the leakage of the backside electric charge of the transfer material having the high resistivity as in the case of OHP film or the like. From this standpoint, the high resistivity is preferred. But, the surface resistance is significantly contributable to this effect, and the surface resistance is preferably not less than $10^{10}$ ohm. The surface resistance is measured in the following manner. As shown in FIG. 3, electrodes 31*a* and 31*c* are wrapped around the periphery of the pressing roller 2 with the width of 10 mm, and 10 volt is applied to the electrodes, and the current I flowing through an electrode 31*b* is measured. The surface resistance R is calculated by the following equation:

$$R=(2\times 2\pi r)V/IL$$

where r is an outer radius of the pressing roller 2, L is a distance between the electrodes (10 mm in this example), and R is the surface resistance.

Figure 4:
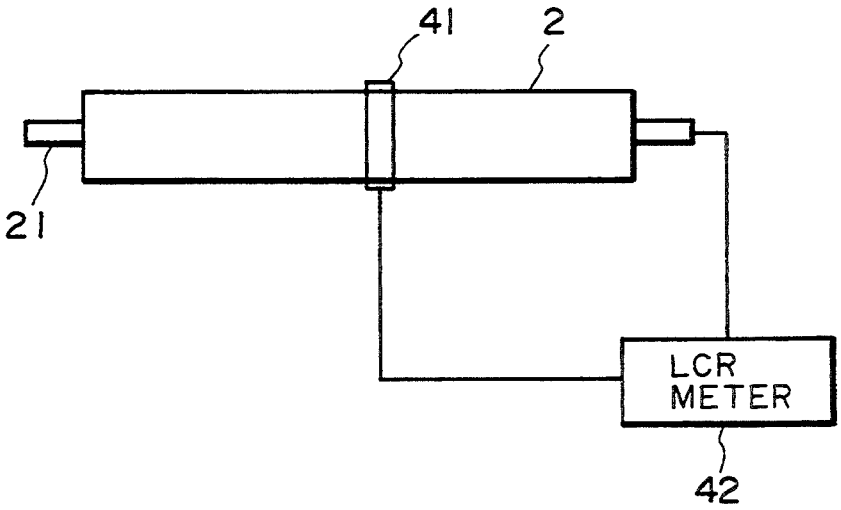
FIG. 4 illustrates a method of measuring electrostatic capacity of an elastic roller.

(2) With the increase of the electrostatic capacity of the pressing roller 2, the surface potential decreases from the electric charge stored in the pressing roller 2, therefore, the electrostatic capacity is preferably large, and is desirably 100 pF. Referring to FIG. 4, the measuring method of the electrostatic capacity will be described. The electrostatic capacity between the core metal 21 of the pressing roller and an electrode 4 having a width of 10 mm and wrapped around the circumferential periphery thereof is measured using LCR meter (AG4304, available from Ando Kabushiki Kaisha, Japan) 42. When the fluorine resin such as PFA, PTFE or PFE is used, it is desirable in order to provide the above electrostatic capacity that the fluorinated resin layer has a thickness of not more than 100 microns increasing the bonding layer, that the resistance of the elastic layer is sufficiently low, and that the volume resistivity of the rubber layer of the elastic layer is not more than $10^7$ ohm.cm.

Figure 5:
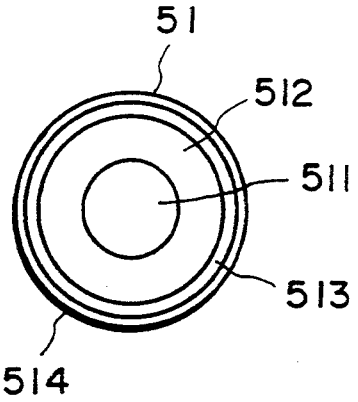
FIG. 5 is a sectional view of an elastic roller according to a second embodiment of the present invention.

Referring to FIG. 5, there is shown a sectional view of a pressing roller 51 according to a second embodiment of the present invention. In this embodiment, the electrically conductive silicone rubber layer 512 is vulcanized and formed on the core metal (conductive base) 511. The volume resistivity of the layer is not more than $10^7$ ohm.cm. A bonding layer 513 which is a mixture of fluorinated rubber and fluorinated resin is applied. Then, dispersion of PFA or FEP or the like is sprayed or the powder thereof is electrostatically painted. Then, the fluorinated resin is heated and sintered at the temperature not less than the fusing point of the fluorinated resin. The surface layer of the pressing roller 51 is of the pure fluorinated resin without filler. However, by fine pinholes produced during the coating, the electric charge on the surface layer attenuates.

Where the electric charge does not attenuate on the surface fluorinated resin layer 514 as when several hundreds of the transfer sheets are continuously processed, the surface potential of the pressing roller 51 gradually increases even if the electrostatic capacity thereof is large. Although the electrostatic force is not sufficient to repel the toner on the transfer material, but the electric charge on the backside of the transfer material is partly lost to neutralize the surface potential of the pressing roller 51 particularly when the high resistance OHP film or the like is used as the transfer material. If this occurs, slight toner off-set is produced. However, because of the feature described above, this problem can be avoided because the excessive electric charge attenuates by the pinholes in the surface layer.

Thus, in this embodiment, similarly to the first embodiment, the electric charge on the backside of the transfer material having the high resistance as in the OHP film or the like, hardly leaks, because the surface resistance of the fluorinated resin surface layer is not less than $10^{10}$ ohm. Therefore, the toner off-set or the like does not occur. On the other hand, the electric charge on the surface leaks through the fine pinholes produced during the coating, and therefore, the surface potential of the pressing roller does not increase. In order to satisfy both of the properties, it is desirable that the volume resistivity of the surface fluorinated resin layer 514 is preferably not more than $10^{14}$ ohm.cm. The prevention of the transfer material from wrapping around the roller is as good as in the first embodiment, and the resistivity is practically good although it is slightly lower than in the first embodiment.

In order to provide the above-described properties, it is desirable that the thickness of the surface fluorine resin layer 514 is 10–30 microns, and a bonding or intermediate layer is preferably provided between the elastic layer and the fluorine resin layer, the intermediate layer having a hardness of 40–80 degrees (JIS A) and a thickness of 10–50 microns. The intermediate layer 513 constitutes an additional elastic layer. By the provision of the intermediate layer, the coating of the surface fluorine resin layer 514 has sufficient strength, and simultaneously it becomes possible to produce proper pinholes.

Figure 6:
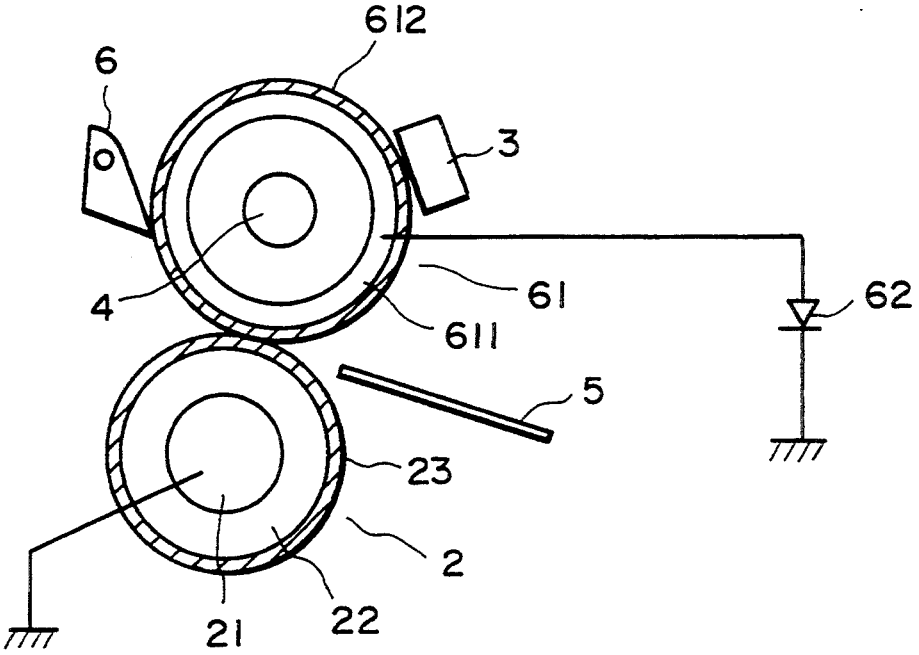
FIG. 6 is a sectional view of an image fixing apparatus according to a third embodiment of the present invention.

FIG. 6 is a sectional view of an image fixing apparatus according to a third embodiment of the present invention. The volume resistivity of the elastic layer of this embodiment is also not more than $10^7$ ohm.cm. In this embodiment, the conductive base of the heating roller I is grounded through a rectifying element (self-bias element) having a low capacity such as a diode 61 or the like, by which the self-bias is applied selectively with the use of the electric charge produced in the fixing roller 1, the electric charge induces in the heating roller 1 to the potential of the transfer material. The surface parting layer 612 of the heating roller 61 may be produced by covering it with a tube having a thickness of 30 microns and sintering the tube, or by applying liquid PFA, PTFE resin in the thickness of 15–30 microns and then sintering it. In either case, the parting layer 612 is not abraded. The surface resistance of the tube or the coating is not more than $10^{10}$ ohm.

In the other respects, the structures are the same as in the first embodiment, and therefore, the detailed description is omitted. In the case of the heating roller 61 not abraded, if foreign matter is mixed during the sintering, the toner off-set occurs with the nucleus of the portion of the foreign matter. Or, since the surface roughness if relatively large (ten point average roughness Rz is not less than 1 micron), it is possible that the toner on the transfer material does not contact the fixing roller, and the toner is attracted to the fixing roller by the electric field with the result of toner off-set. With this structure, the production of the electrostatic charge is not significant in the pressing roller, the toner off-set does not easily occur. However, to further enhance the toner off-set prevention effect, the heating roller 61 is grounded through the self-bias element in the form of the diode 62 in this embodiment. Since the toner used in this embodiment is negatively chargeable toner, the direction of the diode 62 is as shown in FIG. 6. With this structure, the negative charge is produced in the heating roller 61 by the electric charge produced by the triboelectricity with the transfer material and the electric charge induced by the potential of the transfer material, so that the toner off-set can be prevented. Since the present invention uses the pressing roller 2 having the surface fluorine resin layer 23 having the high resistance, and therefore, the potential on the pressing roller 61 does not leak through the pressing roller 2, so that it is possible to provide the toner repelling electric field even if the small size transfer material is used. In addition, the electrostatic capacity of the pressing roller 2 is large, the potential is stabilized, so that the potential of the heating roller 61 is not influenced so much by the potential of the pressing roller 2, and therefore, the toner repelling electric field is provided in accordance with the transfer material.

Because of the provision of the surface fluorinated resin layer 23 having the high resistance on the conductive elastic layer 22, the toner off-set can be prevented even if the heating roller 61 not abraded is used. By the combination with the grounding through the low capacity rectifying element such as diode 62 or the like thus using the self bias effect for the heating roller 61, it is possible to promote the effect of the diode 62. In this embodiment, the diode 62 is used to self-bias the heating roller 61, but a resistor, capacitor, varister or the like is usable. The same advantageous effects can be provided by directly applying a bias voltage having the same polarity as the toner from a power source.

Figure 7:
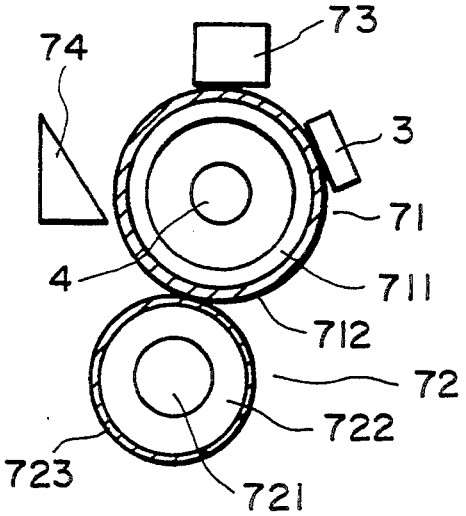
FIG. 7 is a sectional view of an image fixing apparatus according to a fourth embodiment of the present invention.

Referring to FIG. 7, there is shown an image fixing apparatus in a cross-section according to a fourth embodiment of the present invention. In this embodiment, the heating roller 71 is coated with a PFA layer, and the outer diameter thereof is 25 mm with the PFA layer. The pressing roller 72 comprises a conductive silicone rubber layer 722 having the volume resistivity of not more than $10^7$ ohm.cm and having a thickness of 5 mm and a PFA tube-723 thereon having a thickness of 30 microns and having a surface resistivity of not less than $10^{10}$ ohm. The outer diameter thereof is 20 mm. The surface of the heating roller 71 is provided with a thermister 3 and a thermoswitch 73 in an non-image region. A non-contact type separation guide 74 is disposed with a space of 0.3 mm. No cleaning member is used.

With this structure, the heating roller 71 does not contact any member in the image region. Therefore, the damage to the heating roller 71 which have conventionally been given by separation pawls, thermister, thermoswitch or the like, can be avoided, and therefore, the service life of the heating roller 71 can be significantly increased. The service life corresponds to 300,000 sheets of A4 size.

In this embodiment, the pressing roller 72 is provided on a conductive elastic layer with a high resistance resin layer. The thickness of the resin layer including a bonding layer if any is not more than 100 microns. The outer diameter of the heating roller 71 is not more than 25 mm. Then, the necessity for the separating pawls of contact type for the pressing roller 71 is eliminated, and at least in the image region, the transfer material can be separated from the heating roller 74 by the non-contact type separating guide 74.

Since the pressing roller 71 is hardly charged, and therefore, the electrostatic repelling force for the transfer material is eliminated so that the conveying path for the transfer material is stabilized. Under the high temperature and high humidity condition where the rigidity of the transfer material is low, the triboelectric charge hardly occurs. Because of the existence of the conductive layer 722 with the high resistance layer 723 having a small thickness not more than 100 microns, the electric charge of the transfer material induces opposite polarity electric charge on the backside of the high resistance layer of the pressing roller to provide electrostatic attracting force in the detection of assisting the separation of the transfer material from the heating roller 71. Although it has been difficult to separate the less rigid transfer material having absorbed the moisture under the high temperature and high humidity condition except for the outer diameter is not more than 20 mm, the present embodiment makes it possible to sufficiently separate such a transfer material even if the outer diameter is 25 mm. As a result, the sufficient nip width can be used even in a printer, copying machine or the like having relatively low sheet feeding speed, and therefore, the fixing apparatus may be free from the separating pawl, still maintaining the durabilities of the heating roller 71 and the pressing roller 72 of not less than 300,000 sheets.

In the foregoing first - fourth embodiments, the description has been made regarding a pressing roller of a heating roller type fixing apparatus, as an example of the roller having the elastic layer. However, the present invention is applicable to the heating roller if the thickness of the elastic layer of the heating roller is large (not less than 2 mm).

In the foregoing first - fourth embodiments, the resin layer is of fluorine resin, but silicone resin or the like is usable. The elastic layer has been described as being of conductive silicone rubber, but another material is usable such as fluorinated rubber (urethane rubber) EPDM or another conductive rubber. Another conductive material is conductive sponge of silicone rubber, fluorinated rubber, urethane, EPDM or the like which has been foamed.

Then, the description will be made as to fifth - tenth embodiments wherein the off-set is effectively prevented without permitting leakage of electric charge from the backside of the recording material. In these embodiments, the conductive base of the pressing roller (first roller) is grounded through a bias application means in the form of a power source or a self-bias element.

Figure 8:
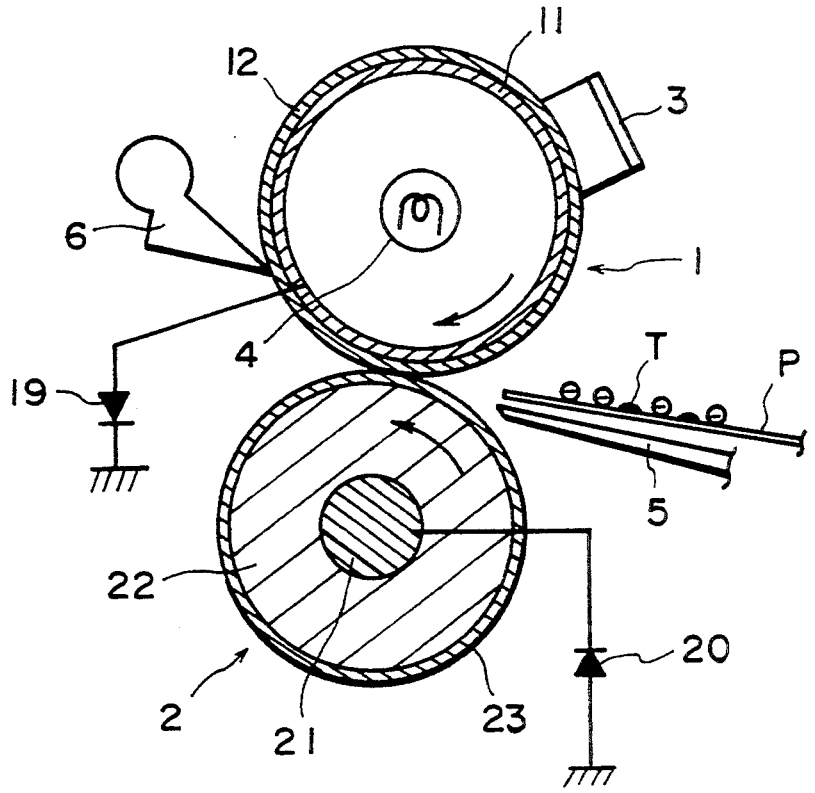
FIG. 8 is a sectional view of an image fixing apparatus according to a fifth embodiment of the present invention.

Referring to FIG. 8, the fifth embodiment will be described. In this embodiment, the elastic layer 13 is made of silicone rubber having a low resistance (not more than $10^7$ ohm.cm, preferably $10^2$ ohm.cm–$10^7$ ohm.cm of the volume resistivity) provided by conductive materials such as surface active agent (metal powder, carbon powder or the like). As the surface layer, an insulating fluorine resin layer 18 of PFA, PTFE or the like is sintered. The core metal is grounded through diode (bias application means) 20. The diode 20 is so directed that the core metal retains the electric charge having the polarity opposite to that of the toner.

The insulative fluorine resin 23 preferably has a volume resistivity of not less than $10^{10}$ ohm.cm, further preferably $10^{14}$ ohm.cm and is made of PFA, for example. The thickness of the coating thereof is 30–50 microns.

The volume resistivity of the low resistance elastic layer 22 is determined on the basis of the thickness of the insulative fluorinated resin 23.

More particularly, the resistance of the elastic layer 22 is selected that the total resistance of the pressing roller 2 is $10^8$–$10^{12}$ ohm.cm between the nip and the core metal 21 under the actual using state. This is because the pressing roller is prevented from charging up, and the electric charge on the backside of the transfer material is prevented from releasing. If the charging-up occurs, the toner retaining force onto the transfer material decreases by the releasing of the electric charge from the surface of the pressing roller, and therefore, the toner off-set occurs. In this embodiment, the insulating fluorine resin layer is of PFA coating of 40 microns having the volume resistivity of approximately $10^{14}$ ohm.cm, and the elastic layer 22 is made of silicone rubber having the volume resistivity of approximately $10^2$ ohm.cm provided by the dispersion of the carbon powder. Then, the resistivity of the pressing roller was $10^{11}$ ohm.cm.

In this embodiment, when negatively charged toner T is used, a diode 20 is connected in the manner shown in the Figure so as to prevent release of the electric charge from the backside of the transfer material and so as to release the negative charge resulting from the triboelectricity. In addition, a diode 19 is connected from the core metal of the fixing roller 1 so as to release the negative charge and so as to retain the negative charge of the polarity which is the same as the charge of the toner T. With this connection of the diode, the off-set preventing effect is further enhanced. In this embodiment, the surface potential of the pressing roller 2 is +100–+500 V, and the surface potential of the fixing roller 1 is 0–200 V, and the electrostatic off-set could be prevented. The parting property of the surface of the pressing roller 2 was good, and the contamination of the roller surface with the toner or the paper dust were prevented for the long term use.

As described in the foregoing, according to the present invention, the fixing apparatus can be provided wherein the triboelectric charge is suppressed, and satisfactory parting property is maintained for a long period of time.

Figure 9:
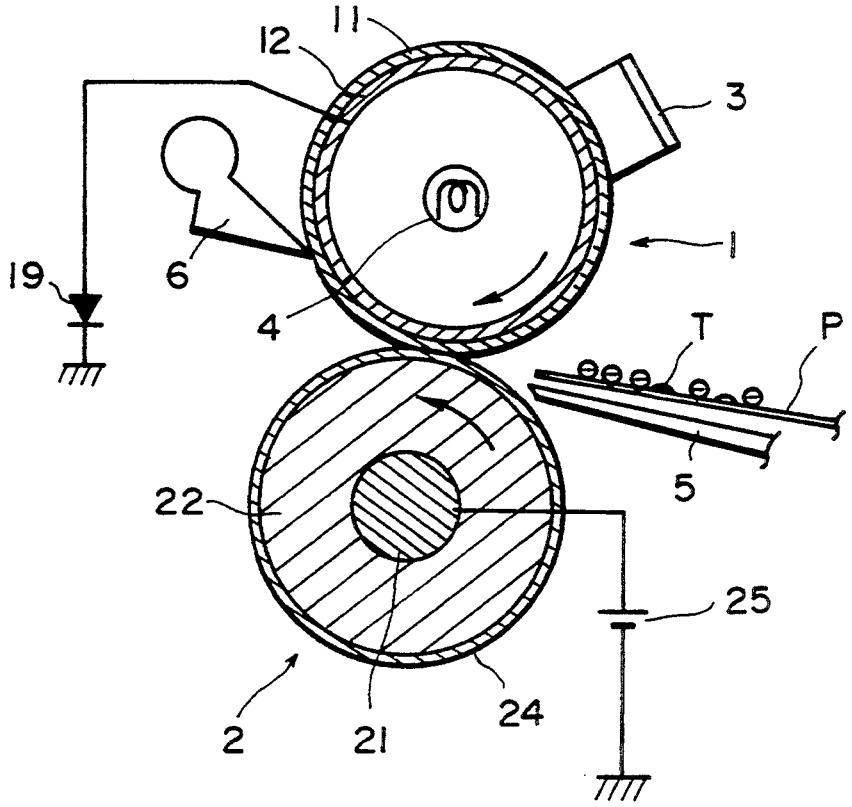
FIG. 9 is a sectional view of an image fixing apparatus according to a sixth embodiment of the present invention.

Referring to FIG. 9, the sixth embodiment of the present invention will be described. In the fifth embodiment, the PFA coating was used as the insulative fluorine resin surface layer. In the present embodiment, the low resistance elastic layer 22 is covered with a heat shrinkable insulative PFA tube 24 having a thickness of 50 microns. The coating by the PFA tube is possible under the relative low temperature condition (160° C.–180° C.). The manufacturing step is simple. The core metal 17 of the pressing roller is supplied with a bias voltage 25 of positive DC so as to forcedly maintain the positive surface potential of the pressing roller 2. The off-set is prevented for the toner negatively charged toner. For the positively charged, the power source and the diode are connected in the opposite direction.

Figure 10:
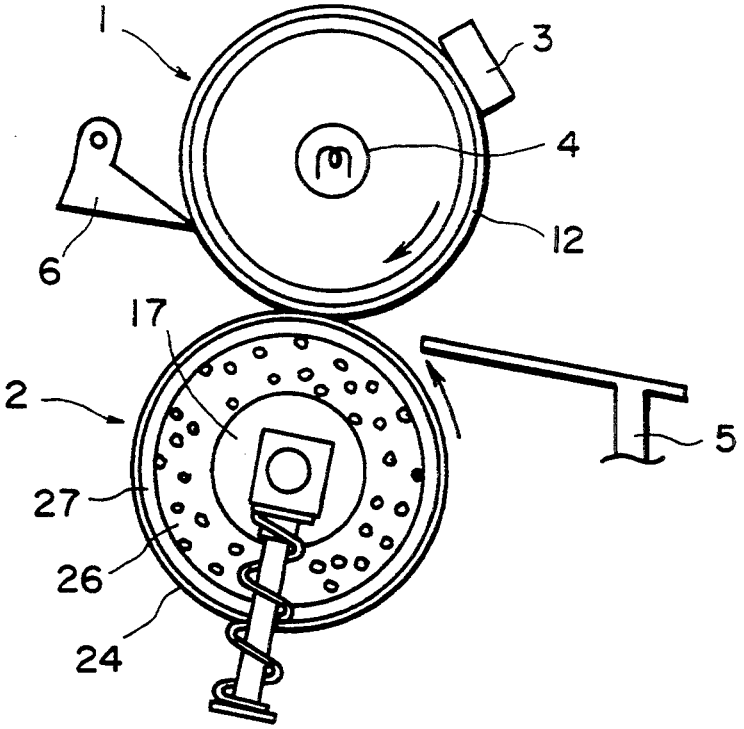
FIG. 10 is a sectional view of an image fixing apparatus according to a seventh embodiment of the present invention.

Referring to FIG. 10, the description will be made as to the seventh embodiment. The present embodiment is different from the-fifth embodiment in that the elastic layer comprises a sponge layer and a rubber layer. When the elastic layer of the pressing roller is a single rubber layer, the hardness of the pressing roller tends to be high. Then, the transfer material tends to crease, particularly when the transfer material is an envelope or the like. In view of this, the elastic layer of the pressing roller in this embodiment comprises a sponge layer 26 having the resistance lowered by metal powder, carbon powder and/or surface active agent and a rubber layer 27 having a low resistance. The surface layer is in the form of an insulating PFA tube 24 which is heat-shrinkable and which has a thickness of 50 microns. For the purpose of comparison, a pressing roller having a diameter of 20 mm and having an elastic layer of silicone rubber having JIS A hardness of 20 degrees (7 mm in the thickness), showed an Asker C hardness of 65 degrees in the final product.

On the other hand, the pressing roller having the outer diameter of 20 mm, using the same insulative PFA tube and the elastic layer comprising the low resistance sponge layer having the thickness of 3 mm and the Asker C hardness is 40 degrees and a low resistance silicone rubber layer having a thickness of 1 mm and a JIS A hardness of 20 degrees, showed the Asker C hardness of 45 degrees in the final product. The former requires total pressure of 12 kg to obtain a nip width of 3 mm which is required for the fixing operation, but the latter requires the total pressure of 8 kg, and therefore, the production of the crease is prevented. In this embodiment, the toner offset does not occur, and the parting properties were good enough.

Figure 11:
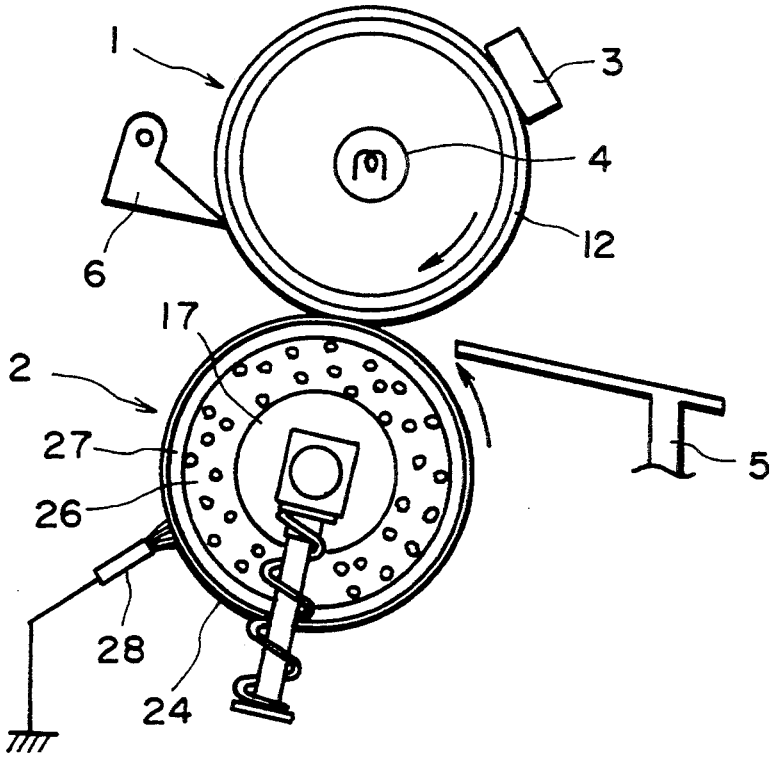
FIG. 11 is a sectional view of an image fixing apparatus according to an eighth embodiment of the present invention.

Referring to FIG. 11, the eighth embodiment will be described. In this embodiment, the roller comprises a conductive base 17, a first elastic layer thereon in the form of a sponge layer 26, a second elastic layer in the form of a silicone rubber layer 27 containing conductive material on the sponge layer 26, and an insulating surface parting layer in the form of PFA tube 24 on the silicone rubber layer 27. It is difficult to lower the resistance of the sponge 26, and it is possible that vulcanization is deteriorated. In view of these, discharging brush 28 is contacted to the surface of the roller so as to remove the surface charge. In this embodiment, the toner off-set is more effectively prevented.

Figure 12:
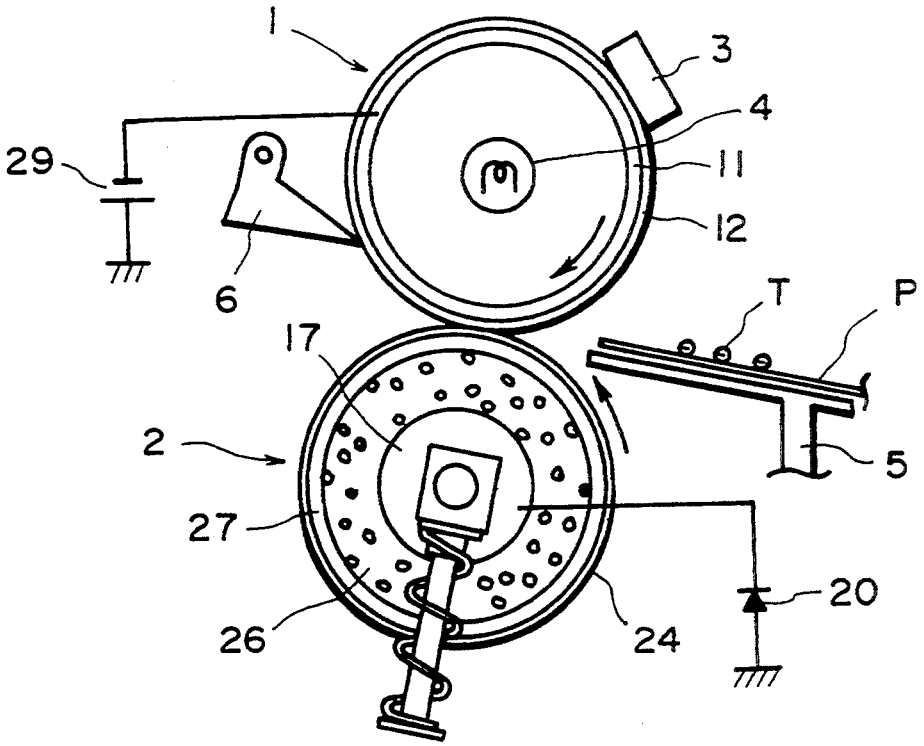
FIG. 12 is a sectional view of an image fixing apparatus according to a ninth embodiment of the present invention.

Referring to FIG. 12, the description will be made as to the ninth embodiment. As shown in FIG. 12, when the negatively charged toner is used, the core metal 11 of the fixing roller is contacted to the power source 29 to provide the same potential as the toner. The core metal 17 of the pressing roller 2 is connected with a diode 20 to provide the potential of the polarity opposite to that of-the toner. As a result, the toner is urged to the transfer material by the electrostatic function, so that the toner off-set is prevented.

According to this embodiment, the toner offset can be further assuredly prevented.

Figure 13:
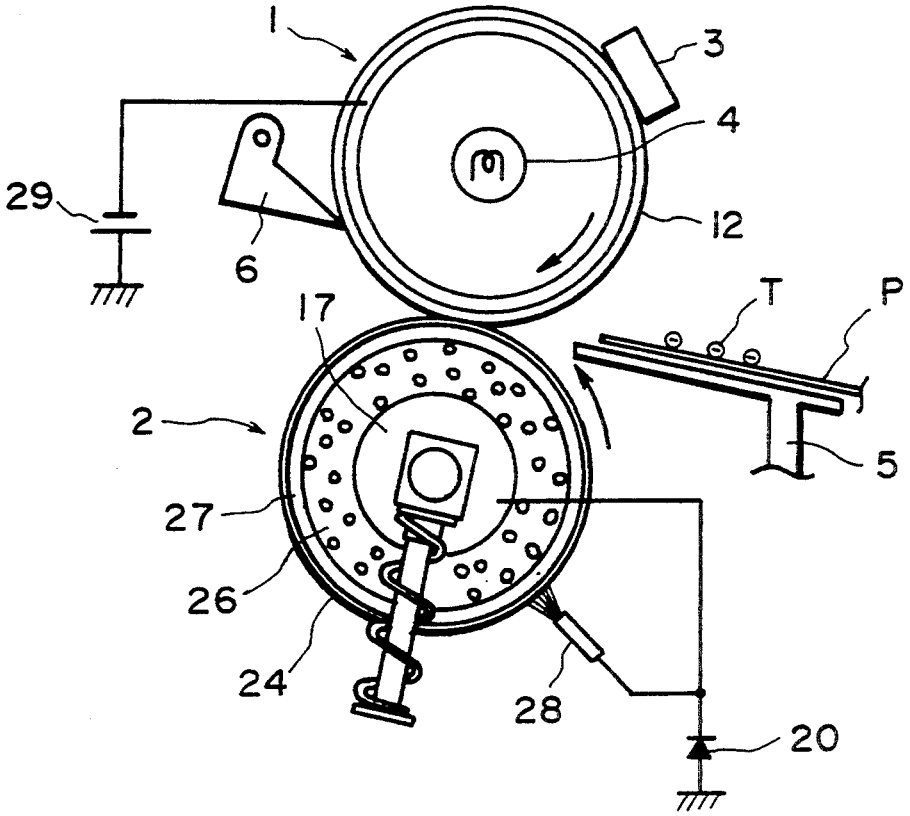
FIG. 13 is a sectional view of an image fixing apparatus according to a tenth embodiment of the present invention.

Referring to FIG. 13, the tenth embodiment of the present invention will be described. In this embodiment, the core metal and the discharging brush are grounded through a diode. The toner off-set can be assuredly prevented in this embodiment, too.

In the foregoing embodiment using a diode, when the positively charged toner is used, the diode and the power source are reversed. The reason why the rubber layer 27 is used between the sponge layer 26 and the tube layer 24 is to increase the bonding property so as to improve the dimensional accuracy. If there is no problem in this respect, the rubber layer 27 may be omitted.

Figure 14:
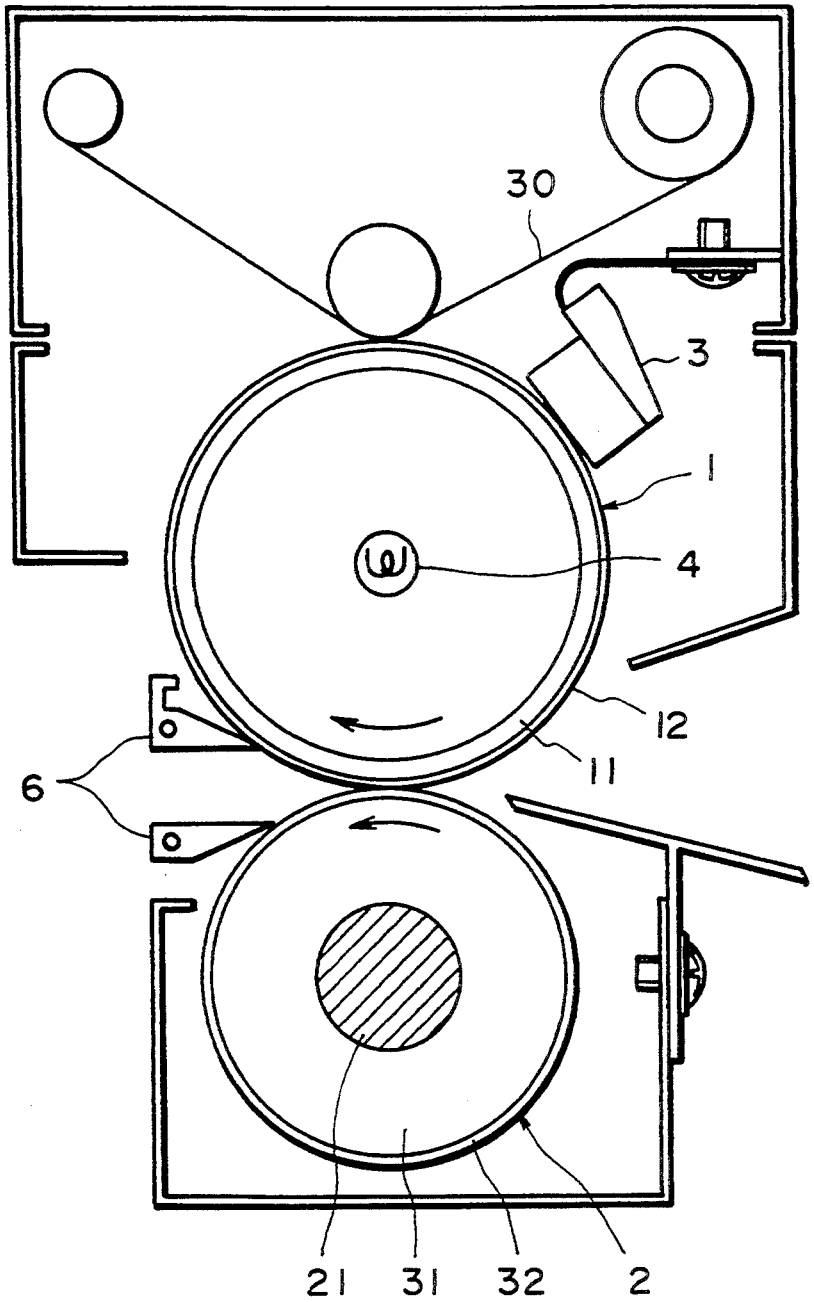
FIG. 14 is a sectional view of an image fixing apparatus according to an eleventh embodiment of the present invention.

Referring to FIG. 14, the eleventh embodiment will be described. In this embodiment, the electrostatic capacity of the elastic roller is large to provide the good parting property and the off-set preventing property, and the composition change due to the long term use is prevented. More particularly, it comprises an elastic layer including conductive material and an insulative surface parting layer. The elastic layer is of addition reaction silicone rubber of FIG. 14 is a sectional view of an image fixing apparatus according to the eleventh embodiment of the present invention. The heat fixing apparatus comprises a fixing roller 1 having a heat source (halogen lamp, in this embodiment) 3 and contactable to an unfixed toner and a pressing roller (first roller) 2 having an elastic layer, the rollers being press-contacted to each other to provide proper nip width therebetween, and being rotated in the directions indicated by arrows by an unshown driving means. A surface temperature of the fixing roller (second roller) 1 is detected by a thermister 3, so that the surface temperature thereof is maintained properly. By passing the recording material through the nip, the heat fusible toner on the recording material is heated and pressed so as to be fixed thereon.

The fixing apparatus further comprises a cleaning web 30 containing silicone oil (parting agent) and separation pawls 6 for preventing the recording material from wrapping around the roller.

The description will be made as to the pressing roller 2. In FIG. 14, the core metal (conductive base) 21 is made of metal, and on the core metal 21, a bottom conductive layer of addition reaction silicone rubber layer 31 is provide. On the silicone rubber layer 31, a surface insulating parting layer 32 having a thickness of 10–100 microns is provided.

The parting layer is preferably made of fluorinated resin such as PTFE, PFA or the like and it is in the form of a tube.

The conductive material for providing the silicone rubber with the conductivity, is not limiting unless the setting (restoring) nature of the silicone rubber is remarkably deteriorated. However, conductive carbon black is suitable.

The material and the content of the conductive carbon black is not limiting if the volume resistivity of cured rubber is not more than $10^7$ ohm.cm, preferably $10^5$ ohm.cm and if JIS-A hardness is not more than 40 degrees. However the content of the carbon black is preferably 1%–50% by weight. If the content exceeds 50% by weight, the hardness of the pressing roller is too high with the result that the contact area is not sufficient when it presses to the fixing roller. This leads to unsatisfactory fixing performance. In addition, the off-set prevention of the pressing roller decreases, and therefore, the conveying performance is deteriorated. If the content is less than 1% by weight, the volume resistivity is not sufficiently low with the result of increased toner off-set.

EXAMPLE 1

Liquid A of addition reaction silicone rubber compound and liquid B of silicone rubber addition reaction compound were uniformly mixed at the weight ratio of 100:100. The liquid A had the viscosity of 800 pores and comprised 100 parts of vinyl group containing diorganopolysiloxane, 10 parts of fine powder of dry silica, 10 parts of Ketjen black EL, 1 part of red oxide and platinum catalyst; the liquid B had the viscosity of 700 pores and comprised 100 parts of mixture of vinyl group containing diorganopolysiloxane and active hydrogen group containing diorganopolysiloxane, 10 parts of fine powder of dry silica, 10 parts of Ketjen black EC. It is injected into a cylindrical metal mold containing stainless steel core metal having a diameter of 10 mm, and was heat-cured at 130° C. for 30 min. to produce a conductive silicone rubber roller having an outer diameter of 20 mm.

The roller is covered with PFA heat shrinkable tube (Gunze Kabushiki Kaisha, GF tube) having a thickness of 30 microns and having a primer-treated inside surface. It was heat-shrinked with hot air blow at 150° C. to provide a pressing roller comprising conductive silicone rubber layer with the surface PFA parting layer. The pressing roller was set in an image fixing apparatus of a heat fixing type, and the continuous fixing operations performed under the following conditions (the fixing roller comprised aluminum core metal having an outer diameter of 20 mm and a PFA tube having a thickness of 30 microns fused thereon).

Fixing conditions:

Surface temperature of the fixing roller controlled: 180° C.

Pressure between the fixing roller and the pressing roller: 8 kgf

Sheet used: A4 sheet (plain paper) having an unfixed toner image of a test pattern.

Process speed: 8 per minute (During the operation, the surface of the fixing roller is not cleaned.)

Even after 100,000 sheets were produced, no trouble in the conveyance of the recording material, such as recording material crease or contamination of the recording material due to toner off-set. The surface of the pressing roller was not contaminated with toner at the end of the operation.

EXAMPLE 2

The surface of the silicone rubber roller in the Example 1 was treated with primer and was sprayed with fluorinated rubber latex GLS 213 (available from Daikin Kogyo Kabushiki Kaisha) into the thickness of 20 microns. After it is dried, it is fixed by heating at 300° C. for 30 min. By doing so,-a pressing roller comprising a silicone rubber layer with a surface parting layer made of fluorinated rubber and fluorinated resin. The pressing roller is used in the operation under the same conditions as experiment 1. After 100,000 sheets were processed, it has been confirmed that no trouble such as crease of the recording material, the contamination of the transfer material due to the toner off-set did not occur. After 100,000 sheets were processed, the surface of the pressing roller was slightly contaminated with toner, but for practical purposes it was not a problem.

COMPARISON EXAMPLE

A stainless steel core metal having an outer diameter of 10 mm is coated by heat with radical reaction type conductive silicone rubber (DY32-931 available from Toray Daw Corning Silicone Kabushiki Kaisha). It is polished, and a conductive silicone rubber roller having a diameter of 20 mm was produced. The surface of the roller is treated with primer, and is sprayed with fluorinated rubber latex GLS 213 (available from Daikin Kogyo Kabushiki Kaisha) into a thickness of 20 microns. After it is dried, it was fixed by heat at 250° C. for 30 minutes.

The pressing roller was used in the same operations as in Example 1. The sheet was sometimes creased due to the insufficiency in the setting property of the rubber so that it is practically not usable.

Thus, the radical reaction silicone rubber which is suitable used with a pressing roller not containing the conductive material is not practical if the conductive material is contained therein. Therefore, as for the silicone rubber containing the conductive material, addition reaction silicone rubber is preferable.

As described in the foregoing, according to the eleventh embodiment, the sheet crease due to the improper setting of the elastic layer is not produced, and the triboelectric charge and the toner offset is small, and in addition, the durability is good.

Figure 15:
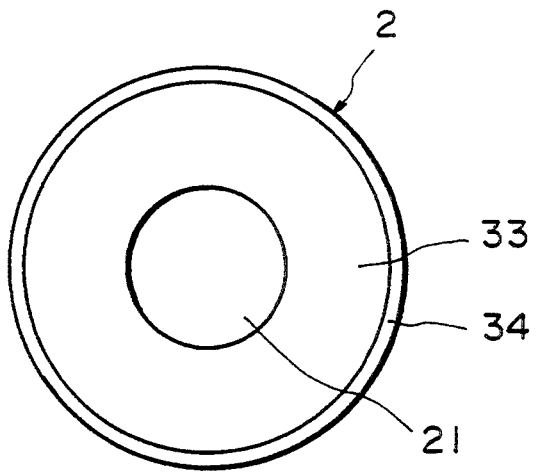
FIG. 15 is a sectional view of an elastic roller according to a twelfth embodiment of the present invention.

Referring to FIG. 15, the description will be made as to twelfth embodiment wherein the electrostatic capacity of the elastic roller is increased so as to maintain the good parting property and the good off-set preventing property, and wherein the surface parting layer is not easily peeled off the elastic layer. More particularly, it comprises the conductive base, the conductive elastic layer and a surface parting layer made of a mixture of the fluorine rubber and the fluorine resin on the elastic layer.

FIG. 15 is a sectional view of a pressing roller. The pressing roller (parting elastic roller) 2 comprises a cylindrical core metal (conductive base) 21, a conductive rubber layer (conductive elastic layer) 33. The pressing roller 2 is press-contacted to a fixing roller having a temperature controlled normally at a predetermined temperature (150° C.–200 ° C.), and therefore, the conductive rubber 33 is sufficient if it has the heat resistivity against such temperature. There is no additional limitation to it. The volume resistivity of the conductive rubber is preferably not more than $10^7$ ohm.cm, further preferably not more than $10^5$ ohm.cm.

On the conductive rubber layer 33, a surface parting layer 34A made of a mixture of the fluorine rubber and the fluorine resin is formed. The thickness of the surface layer 34 is not more than 1 mm, and preferably not more than 0.1 mm. If the thickness of the surface layer 34 exceeds 1 mm, the electrostatic capacity of the surface layer 34 becomes too small with the result of too high triboelectric charge, and therefore, the sufficient toner off-set preventing effect is not provided.

A stainless steel core metal 21 having an outer diameter of 10 mm is coated by heat with conductive silicone rubber (DY32-931: Toray Daw Corning Silicone Kabushiki Kaisha) having the volume resistivity of $10^2$ ohm.cm. The surface thereof is polished, and the conductive silicone rubber roller having an outer diameter of 20 mm was produced. Then, it is sprayed with water mixture of the fluorine rubber and the fluorine resin (GLS 213: Daikin Kogyo Kabushiki Kaisha) by spray. The thickness of the coating was 20 microns.

Figure 16:
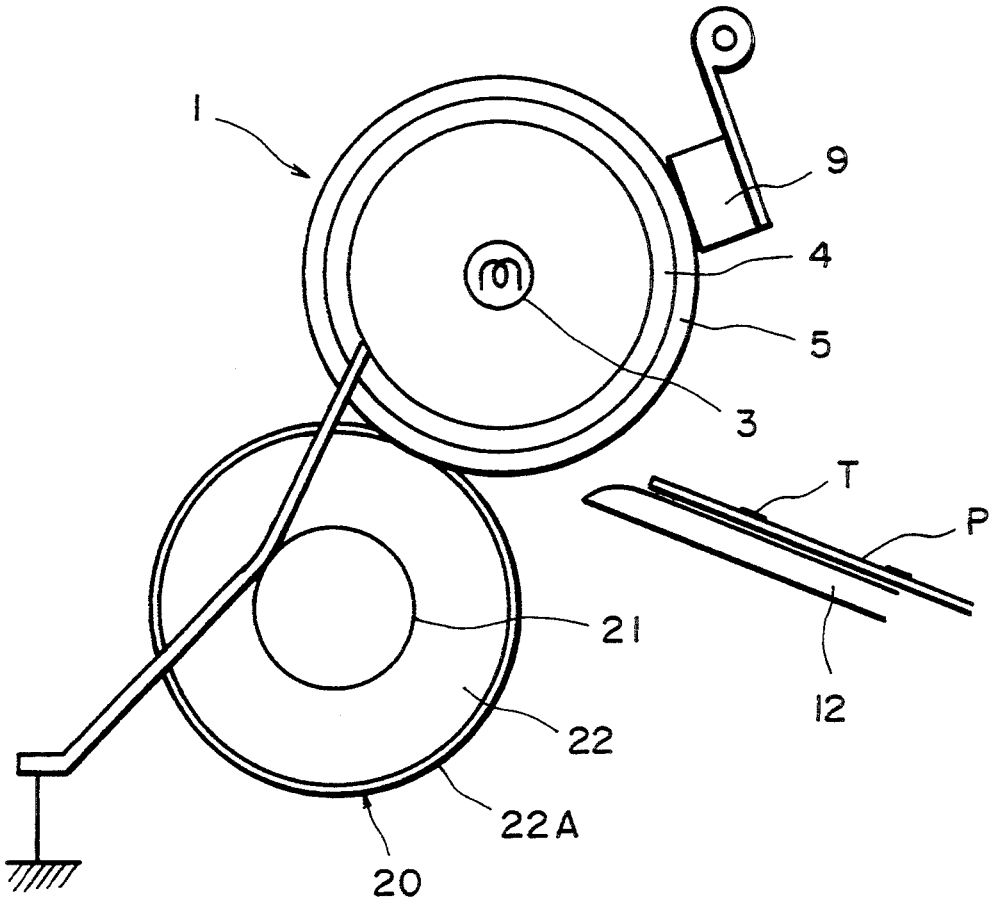
FIG. 16 is a sectional view of an image fixing apparatus using the elastic roller of FIG. 15.

The pressing roller is set in the heat fixing type apparatus shown in FIG. 16 without cleaning felt and without discharging needles. The continuous fixing operations were performed under the following fixing conditions (the fixing roller had the outer diameter of 25 mm and comprised aluminum core metal and a PFA tube having a thickness of 30 microns fused on the core metal; and the fixing and pressing rollers are both grounded).

Fixing conditions:

The fixing roller surface temperature controlled: 150° C.

The pressure between the fixing roller and the pressing roller: 6 kgf

Sheets: A4 transfer sheet (plain paper) having an unfixed toner image of a test pattern Processing speed: 4 sheets per minute During the operation, no cleaning for the surface of the fixing roller was performed.

After 100,000 sheets were processed, it was confirmed that the transfer sheet was not at all contaminated due to the toner off-set. The surface of the pressing roller was not contaminated with the toner after the end of the test.

Conventionally, the volume resistivity of the pressing roller was $10^9$–$10^{11}$ ohm.cm, and therefore, the roller surface potential is not less than −3 KV due to the friction with the paper. In this embodiment, however, it is −200–300 V, and therefore, the toner does not jump to the fixing roller by the electric force (electrostatic off-set). In addition, the mixture of the fluorine resin and the fluorine rubber at the surface exhibits satisfactory non-stickiness, and therefore, the durability is increased.

For the purpose of comparison, the same operations were performed with a pressing roller having only the conductive silicone rubber without the provision of the mixture layer (surface layer) of the fluorine rubber and the fluorine resin. It has been found that since the resistance of the pressing roller is low the toner off-set is not visually apparent. However, a significant amount of carbon is mixed for the purpose of lowering the pressing roller, the surface energy of the rubber is high with the result of degraded parting property of the roller. Gradually, the pressing roller acquired the toner deposited thereto. When 100,000 sheets were processed, the transfer sheet was contaminated.

The elastic layer was made of rubber layer having the volume resistivity of $10^{13}$ ohm.cm, and a layer of mixture of the fluorine rubber and the fluorine resin was provided thereon. Then, the volume resistivity of the pressing roller was $10^{14}$–$10^{15}$ ohm.cm. By the friction with the recording sheet or the like, the potential of the pressing roller was −5 KV with the result of electrostatic toner off-set occurred.

In the twelfth embodiment, the conductive rubber was a silicone rubber in which carbon is dispersed. However, the present invention is not limited to this material. The material will suffice if it is durable against the fixing temperature (150° C.–200 ° C.). The same advantageous effects were provided when the carbon is dispersed in fluorine rubber.

The weight content ratio of the fluorine rubber to the fluorine resin is preferably 95:5 - 65:35. The fluorine rubber may contain as the base fluorinated vinylidene, hexafluorinated propylene, tetrafluorinated ethylene or the like. The fluorine resin may be tetrafluoroethylene copolymer, tetrafluoroethylene perfluoroalkoxyvinylether copolymer, tetrafluoroethylene-hexafluoropropylene copolymer.

The reason why the weight ratio of the fluorine rubber to the fluorine resin is 95:5 - 65:35 is that if the content of the fluorine resin is lower than the above lower limit, the parting property is degraded, and if it is larger than the upper limit, it is difficult to form the surface layer having a thickness of 1 mm or less.

If the mixture of the fluorine rubber and the fluorine resin is used as the surface parting layer, the fluorine resin is concentrated toward the roller surface during the formation of the surface layer, and the fluorine rubber is concentrated to the elastic layer side.

Accordingly, the parting layer is maintained at the roller surface, and therefore, the bonding property of the surface parting layer to the elastic layer is improved, so that the parting elastic roller is durable for long term use.

As described in the foregoing, according to the present embodiment, the elastic roller used in the image fixing apparatus is provided with a conductive rubber on a cylindrical core metal. In addition, the surface layer is made of a mixture of the fluorine rubber and the fluorine resin having a thickness of not more than 1 mm. Therefore, the triboelectric charge during the sheet processing is small, and the toner off-set amount is small, and therefore, the parting property is satisfactory for a long period of time.

While the invention has been described with reference to the structures disclosed herein, it is not confined to the details set forth and this application is intended to cover such modifications or changes as may come within the purposes of the improvements or the scope of the following claims.

What is claimed is:

1. A pressing roller for fixing an image, comprising:

an electrically conductive base;

a rubber layer on said base; and a surface fluorine resin layer on said rubber layer, wherein said rubber layer has a volume resistivity of not more than $10^7$ ohm.cm and said surface fluorine resin layer has a surface resistance of not less than $10^{10}$ ohm, wherein a thickness of said surface fluorine resin layer is 10–100 microns.

2. A roller according to claim 1, wherein said rubber elastic layer contains conductive material.

3. A roller according to claim 2, wherein the conductive material is carbon black, metal or metal oxide.

4. A roller according to claim 1, wherein said rubber layer is of silicone rubber, and said surface fluorine resin layer is of fluorine resin tube.

5. A roller according to claim 4, wherein said fluorine resin is PFA or FEP.

6. A roller according to claim 1, wherein said elastic layer has a thickness of 2–10 mm.

7. A roller according to claim 1, wherein said rubber layer has a JIS-A hardness of 10–40 degrees.

8. A roller according to claim 1, further comprising a primer layer between said rubber layer and said surface fluorine resin layer for bonding them.

9. A roller according to claim 8, wherein said primer layer is of a mixture of fluorine rubber and fluorine resin.

10. A roller according to claim 8, wherein said primer layer has a JIS-A hardness of 40–80 degrees, and a thickness of 10–50 microns.

11. An image fixing apparatus, comprising:

first and second rollers press-contacted to each other, said rollers forming a nip therebetween through which a recording material having an unfixed image is passed to fix the image on the recording material;

said first roller including an electrically conductive base;

a rubber layer on said base; and a surface fluorine resin layer on said rubber layer, wherein said rubber layer has a volume resistivity of not more than $10^7$ ohm.cm and said surface fluorine resin layer has a surface resistance of not less than $10^{10}$ ohm, wherein a thickness of said surface fluorine resin layer is 10–100 microns.

12. An apparatus according to claim 11, wherein said rubber layer contains conductive material.

13. An apparatus according to claim 12, wherein the conductive material is carbon black, metal or metal oxide.

14. An apparatus according to claim 11, wherein said elastic layer is of silicone rubber, and said surface parting layer is of fluorine resin tube.

15. An apparatus according to claim 14, wherein said fluorine resin is PFA or FEP.

16. An apparatus according to claim 11, wherein said rubber layer has a thickness of 2–10 mm.

17. An apparatus according to claim 11, wherein said elastic layer has a JIS-A hardness of 10–40 degrees.

18. An apparatus according to claim 11, further comprising a primer layer between said rubber layer and said surface fluorine resin layer for bonding them.

19. An apparatus according to claim 18, wherein said primer layer is of a mixture of fluorine rubber and fluorine resin.

20. An apparatus according to claim 18, wherein said primer layer has a JIS-A hardness of 40–80 degrees, and a thickness of 10–50 microns.

21. An apparatus according to claim 11, wherein said conductive base is grounded.

22. An apparatus according to claim 11, wherein said second roller comprises a conductive base which is grounded through a self-bias element.

23. A pressing roller for fixing an image, comprising:
an electrically conductive base;
a silicone rubber layer on said base, said silicone rubber layer containing electrically conductive material; and
a surface parting layer on said silicone rubber layer,
wherein said silicone rubber layer has a volume resistivity of not more than $10^7$ ohm.cm and is of addition reaction silicone rubber.

24. A roller according to claim 23, wherein said surface layer is of fluorine resin tube.

25. A roller according to claim 23, wherein said surface layer has a thickness of 10–100 microns.

26. A roller according to claim 23, wherein said rubber layer contains conductive carbon black.

27. A roller according to claim 23, wherein said rubber layer has a JIS-A hardness of not more than 40 degrees.

28. A roller according to claim 26, wherein content of said conductive carbon black is 1–50% by weight.

29. A roller according to claim 23, wherein said surface layer is of a mixture of fluorine resin and fluorine rubber.

30. An image fixing apparatus, comprising:
first and second rollers press-contacted to each other, said rollers forming a nip therebetween through which a recording material having an unfixed image is passed to fix the unfixed image on the recording material;
said first roller including;
an electrically conductive base;
an silicone rubber layer on said conductive base, said silicone rubber layer containing electrically conductive material; and
a surface parting layer on said rubber layer,
wherein said silicone rubber layer has a volume resistivity of not more than $10^7$ ohm.cm and is of addition reaction silicone rubber.

31. An apparatus according to claim 30, wherein said rubber layer has a volume resistivity of not more than $10^7$ ohm.cm.

32. An apparatus according to claim 30, wherein said surface layer is of fluorine resin tube.

33. An apparatus according to claim 30, wherein said surface layer has a thickness of 10–100 microns.

34. An apparatus according to claim 30, wherein said rubber layer contains conductive carbon black.

35. An apparatus according to claim 30, wherein said rubber layer has a JIS-A hardness of not more than 40 degrees.

36. An apparatus according to claim 34, wherein content of said conductive carbon black is 1–50% by weight.

37. An apparatus according to claim 30, wherein said surface layer is of a mixture of fluorine resin and fluorine rubber.

38. An apparatus according to claim 30, wherein said second roller is heated by a heating source and is contactable to the unfixed image.

39. An image fixing apparatus, comprising:
first and second rollers press-contacted to each other, said rollers forming a nip therebetween through which a recording material carrying an unfixed image is passed to fix the unfixed image on the recording material;
said first roller including:
an electrically conductive base;
a rubber layer on said base, said rubber layer having a volume resistivity of not more than $10^7$ ohm.cm;
a surface parting layer on said rubber layer, said surface parting layer having a surface resistance of not less than $10^{10}$ ohm; and
connecting means for electrically grounding said rubber layer.

40. An apparatus according to claim 31, wherein said elastic layer has a volume resistivity of not more than $10^7$ ohm.cm.

41. An apparatus according to claim 39, wherein said connecting means includes one of a voltage source and a self-bias element.

42. An apparatus according to claim 39, wherein said rubber layer contains conductive material.

43. An apparatus according to claim 39, wherein said surface parting layer is of fluorine resin tube.

44. An apparatus according to claim 39, wherein said surface layer has a thickness of 30–50 microns.

45. An apparatus according to claim 39, wherein said rubber layer is of silicone rubber.

46. An apparatus according to claim 39, wherein said second roller is contactable to the unfixed image and said connecting means has a voltage applying means of a polarity which is opposite from a polarity of the unfixed image.

47. An apparatus according to claim 39, wherein said second roller is heated by a heating source and is contactable to the unfixed toner image.

* * * * *

UNITED STATES PATENT AND TRADEMARK OFFICE

CERTIFICATE OF CORRECTION

PATENT NO. : 5,420,679

DATED : May 30, 1995

INVENTOR(S) : MASAHIRO GOTO, ET AL.

It is certified that error appears in the above-indentified patent and that said Letters Patent is hereby corrected as shown below: Title page:

Item [56]: "1227179 9/1989 Japan" should read --1-227179 9/1989 Japan--; and "2226287 9/1990 Japan" should read --2-226287 9/1990 Japan--.

Column 1,
line 42, "result" should read --results--; and
line 45, "is" should read --are--.

Column 3,
line 38, "controls" should read --control--;
line 58, "if" (second occurrence) should read --is--; and
line 59, "if" (second occurrence) should read --is--.

Column 4,
line 62, "are" should read --is--.

Column 6,
line 47, "but" should be deleted.

UNITED STATES PATENT AND TRADEMARK OFFICE

CERTIFICATE OF CORRECTION

PATENT NO. : 5,420,679
DATED : May 30, 1995
INVENTOR(S) : MASAHIRO GOTO, ET AL.

It is certified that error appears in the above-indentified patent and that said Letters Patent is hereby corrected as shown below:

Column 7,
line 41, "if" should read --is--;
line 46, "roller, the" should read --roller and the--; and
line 61, "and" should be deleted.

Column 8,
line 12, "varister" should read --varistor--;
line 24, "tube-723" should read --tube 723--; and
line 33, "have" should read --has--.

Column 9,
line 54, "selected" should read --selected 50--.

Column 10,
line 20, "were" should read --was--;
line 39, "toner." should be deleted and "charged," should read --charged toner,--; and
line 43, "the-fifth" should read --the fifth--.

Column 11,
line 27, "of-the" should read --of the--.

UNITED STATES PATENT AND TRADEMARK OFFICE

CERTIFICATE OF CORRECTION

PATENT NO. : 5,420,679

DATED : May 30, 1995

INVENTOR(S) : MASAHIRO GOTO, ET AL.

It is certified that error appears in the above-indentified patent and that said Letters Patent is hereby corrected as shown below:

Column 12,
line 9, "provide." should read --provided.--.

Column 13,
line 8, "produced," should read --produced, there was--;
line 21, "so,-a" should read --so, a--;
line 26, "no" should be deleted;
line 37, "Daw" should read --Dow--; and
line 51, "suitable" should read --suitably--.

Column 14,
line 26, "Daw" should read --Dow--.

Column 16,
line 10, "elastic" should be deleted;
line 52, "elastic" should read --rubber--;
line 53, "ing" should be deleted; and
line 59, "elastic" should read --rubber--.

Column 17,
line 38, "an" should read --a--.

Signed and Sealed this

Seventh Day of November, 1995

Bruce Lehman

*Attest:*

BRUCE LEHMAN

*Attesting Officer*

*Commissioner of Patents and Trademarks*